US011891878B2

(12) United States Patent
Frazier et al.

(10) Patent No.: US 11,891,878 B2
(45) Date of Patent: Feb. 6, 2024

(54) GAS CAPABLE FRANGIBLE DISC BARRIER VALVE

(71) Applicant: NINE DOWNHOLE TECHNOLOGIES, LLC, Houston, TX (US)

(72) Inventors: W. Lynn Frazier, Corpus Christi, TX (US); Steven Bailey, Corpus Christi, TX (US); Ronald Abt, Portland, TX (US)

(73) Assignee: NINE DOWNHOLE TECHNOLOGIES LLC, Houston, TX (US)

( * ) Notice: Subject to any disclaimer, the term of this patent is extended or adjusted under 35 U.S.C. 154(b) by 0 days.

(21) Appl. No.: 18/109,723

(22) Filed: Feb. 14, 2023

(65) Prior Publication Data

US 2023/0265739 A1 Aug. 24, 2023

Related U.S. Application Data

(63) Continuation of application No. 16/259,910, filed on Jan. 28, 2019, now Pat. No. 11,578,559.

(60) Provisional application No. 62/622,678, filed on Jan. 26, 2018.

(51) Int. Cl.

| | |
|---|---|
| ***E21B 34/06*** | (2006.01) |
| ***E21B 33/124*** | (2006.01) |
| ***E21B 34/10*** | (2006.01) |

(52) U.S. Cl.

CPC ..... *E21B 34/063* (2013.01); *E21B 33/124* (2013.01); *E21B 34/10* (2013.01)

(58) Field of Classification Search

CPC ..... E21B 34/063; E21B 33/124; E21B 34/10

See application file for complete search history.

(56) References Cited

U.S. PATENT DOCUMENTS

| | | | | |
|---|---|---|---|---|
| 5,924,696 | A * | 7/1999 | Frazier | E21B 34/063 138/90 |
| 6,044,908 | A * | 4/2000 | Wyatt | E21B 34/14 277/648 |
| 7,806,189 | B2 * | 10/2010 | Frazier | E21B 34/063 166/376 |
| 9,291,031 | B2 * | 3/2016 | Frazier | E21B 34/063 |
| 11,578,559 | B2 * | 2/2023 | Frazier | E21B 34/10 |
| 2011/0084477 | A1 * | 4/2011 | Mallis | C10M 145/28 285/94 |
| 2011/0277987 | A1 * | 11/2011 | Frazier | E21B 33/1204 166/325 |

(Continued)

*Primary Examiner* — Tara Schimpf
*Assistant Examiner* — Neel Girish Patel
(74) *Attorney, Agent, or Firm* — Morgan, Lewis & Bockius LLP

(57) ABSTRACT

A downhole temporary pressure isolation tool configured to withstand very high gas pressures at high temperatures may be achieved by a variety of configurations, processes, and techniques. In particular implementations, a barrier valve having one or more frangible discs configured to resist fluid flow in a particular specified duration. In some implementations, the barrier valve may achieve a V0 rating. In one embodiment, for example, a barrier valve may prevent the passage of fluid (i.e., gas and/or liquid) at 15,000 psi and a temperature of 400 degrees F. for at least 15 minutes. If the barrier valve has two frangible ceramic discs, it may prevent the passage of fluid from two directions for at least 15 minutes.

25 Claims, 7 Drawing Sheets

(56) References Cited

U.S. PATENT DOCUMENTS

| | | | | |
|---|---|---|---|---|
| 2011/0284242 | A1* | 11/2011 | Frazier | E21B 34/063 166/376 |
| 2011/0284243 | A1* | 11/2011 | Frazier | E21B 34/063 166/376 |
| 2012/0279700 | A1* | 11/2012 | Frazier | E21B 34/063 166/192 |
| 2014/0008085 | A1* | 1/2014 | Tinnen | E21B 33/134 166/134 |
| 2014/0076571 | A1* | 3/2014 | Frazier | E21B 43/261 166/308.1 |
| 2014/0083716 | A1* | 3/2014 | Frazier | E21B 34/10 166/376 |
| 2014/0216756 | A1* | 8/2014 | Getzlaf | E21B 7/20 166/376 |
| 2015/0068730 | A1* | 3/2015 | Frazier | E21B 34/063 166/181 |
| 2017/0022783 | A1* | 1/2017 | Yong | E21B 34/10 |
| 2017/0138153 | A1* | 5/2017 | Getzlaf | E21B 17/14 |
| 2019/0032442 | A1* | 1/2019 | Kohn | F16J 15/16 |
| 2020/0308946 | A1* | 10/2020 | Freeman | E21B 33/124 |

* cited by examiner

GAS CAPABLE FRANGIBLE DISC BARRIER VALVE

RELATED APPLICATIONS

This application is a continuation of U.S. patent application Ser. No. 16/259,910, filed Jan. 28, 2019, which claims priority to U.S. Patent Application No. 62/622,678, filed Jan. 26, 2018. These prior applications are herein incorporated by reference in their entirety.

FIELD OF THE INVENTION

Downhole pressure isolation tools for use in a tubing string, casing string, or other suitable assembly, the downhole isolation tool able to prevent the passage of high pressure fluids (i.e., liquid and/or gas).

BACKGROUND OF THE INVENTION

Isolation tools are used in oil and gas wells for running in or placement on tubing strings for isolation of formations or pressures within the well. Isolation tools may include frangible disks, such as described in U.S. Pat. Nos. 9,291,031 and 5,924,696 and U.S. Patent Publication Nos. 2017/0022783; 2015/0068730 and 2014/0083716, all incorporated herein by reference.

There are a number of situations in the completion of oil and gas wells where it is desirable to isolate one section of a subterranean well from another. For example, in U.S. Pat. No. 5,924,696, there is disclosed an isolation tool used alone or in combination with a packer to isolate a lower section of a production string from an upper section. That tool incorporates a pair of oppositely facing frangible or rupturable discs or half domes which isolate the well below the discs from pressure operations above the discs and which isolate the tubing string from well bore pressure. When it is desired to provide communication across the tool, the upper disc is ruptured by dropping a go-devil into the well from the surface or well head which falls into the well and, upon impact, fractures the upwardly convex ceramic disc. The momentum of the go-devil normally also ruptures the lower disc, but the lower disc may be broken by application of pressure from above after the upper disc is broken because the lower disc is concave upwardly and thereby relatively weak against applied pressure from above.

SUMMARY

A barrier valve having one or more frangible ceramic discs may be configured to resist fluid flow in a particular specified duration. In one embodiment, for example, a barrier valve may prevent the passage of fluid (i.e., gas and/or liquid) at 15,000 psi and a temperature of 400 degrees F. for at least 15 minutes. If the barrier valve has two frangible ceramic discs, it may prevent the passage of fluid from two directions for at least 15 minutes.

An example barrier valve so configured may include an annular cartridge between the outside of the frangible disc and the inside of the housing of the barrier valve. The cartridge may receive an elastomeric member on one side to seal to the frangible disc and an elastomeric member on another side to seal to the housing. By properly controlling the spacing between the cartridge, the frangible disc, and the housing, the sealing may be achieved even in the presence of unavoidable manufacturing tolerances.

In certain implementations, the spacing between the frangible disc, the cartridge, and the housing may range between 0.003 inches and 0.009 inches when taking into account manufacturing tolerances. In some implementations, an annular base of the frangible disc may have a tolerance of 0.045 inches in total indicated runout. Additionally, the frangible disc, which may be made of ceramic, may have a surface finish of no more than 63 micro inches (rms).

In particular implementations, the elastomeric members may be engaged by backup rings in the grooves. The backup rings assist in preventing the elastomeric members from being extruded into gaps between the cartridge and the frangible disc and the housing. The backup rings may have a flat face for engaging the elastomeric members or an arcuately-grooved face.

In certain implementations, the elastomeric member may be coated with a lubricant (e.g., a high viscosity oil or grease). This may assist in sealing imperfections in the surface of the frangible disc, which may be a ceramic.

Various features will be evident to those skilled in the art in light of the following written description and the accompanying drawings. The features of any particular implementation are typically achievable in other implementations even if not described explicitly therein.

DETAILED DESCRIPTION OF EXAMPLE IMPLEMENTATIONS

A gas capable ceramic disc barrier valve is provided. The term "barrier valve" refers to any downhole tool used to at least temporarily isolate one wellbore zone from another, including any tool with blind passages or plugged mandrels, as well as open passages extending completely there through and passages blocked with a check valve. Such tools can be a single assembly (i.e., one barrier valve) or comprise two or more assemblies disposed within a work string or otherwise connected and run into a wellbore on a wireline, slickline, production tubing, coiled tubing or any technique known or yet to be discovered in the art. A barrier valve is to provide maintenance of fluid pressure in a tubular or casing string or provide for partial or total elimination of a borehole blockage to allow fluid communication through the barrier valve and the tubular or casing string.

Figure 1:
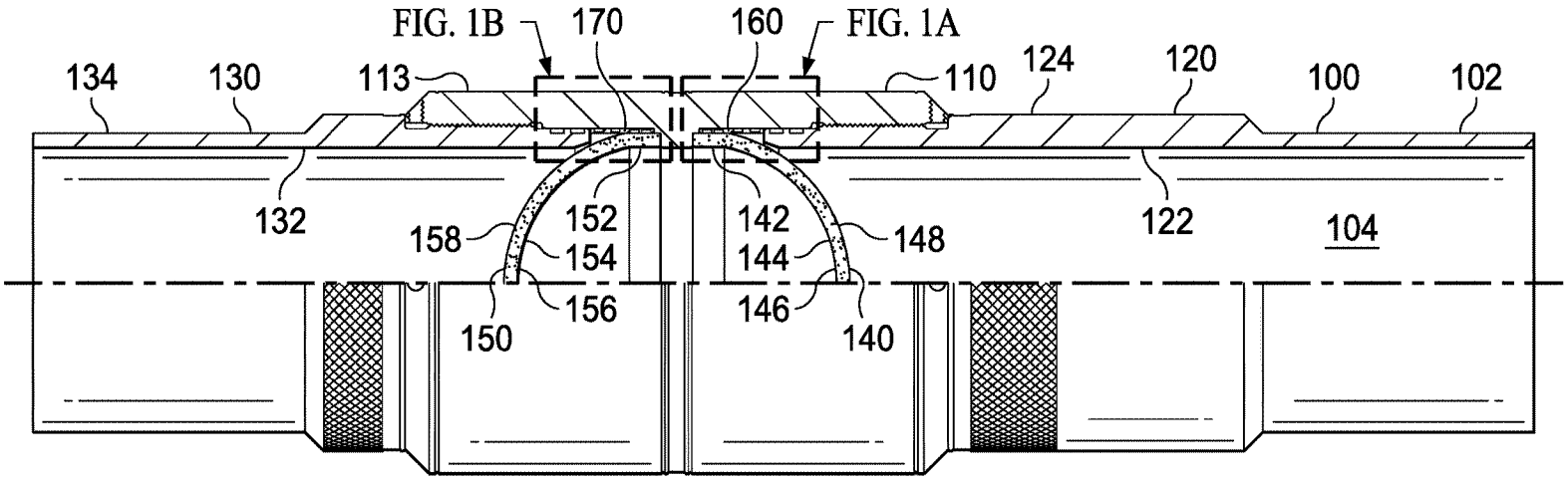
FIG. 1 is a line drawing illustrating an example gas capable ceramic disc barrier valve in partial cross section.
Figure 1A:
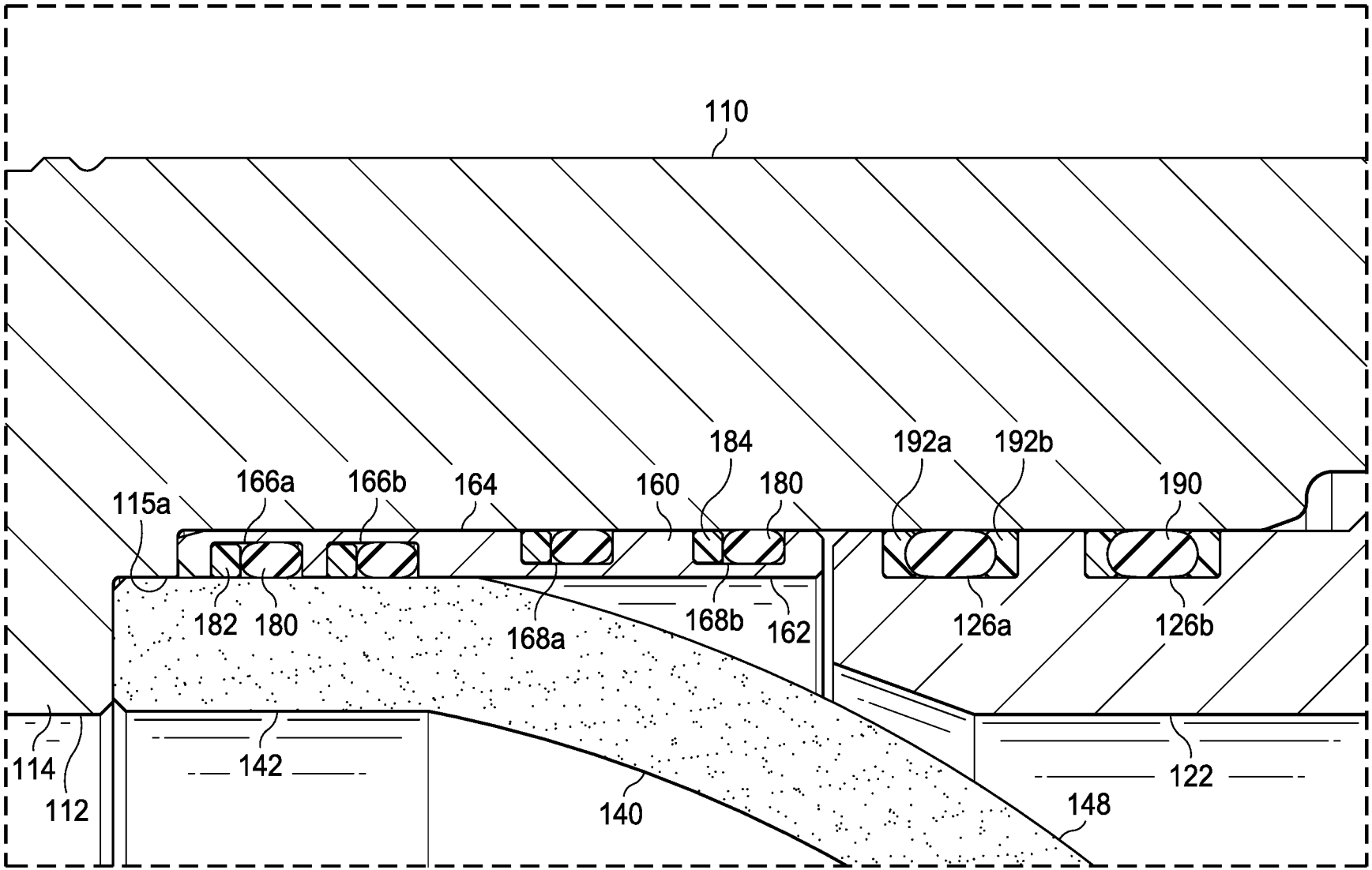
FIG. 1A is a line drawing illustrating a detailed view of one portion of the barrier valve of FIG. 1.
Figure 1B:
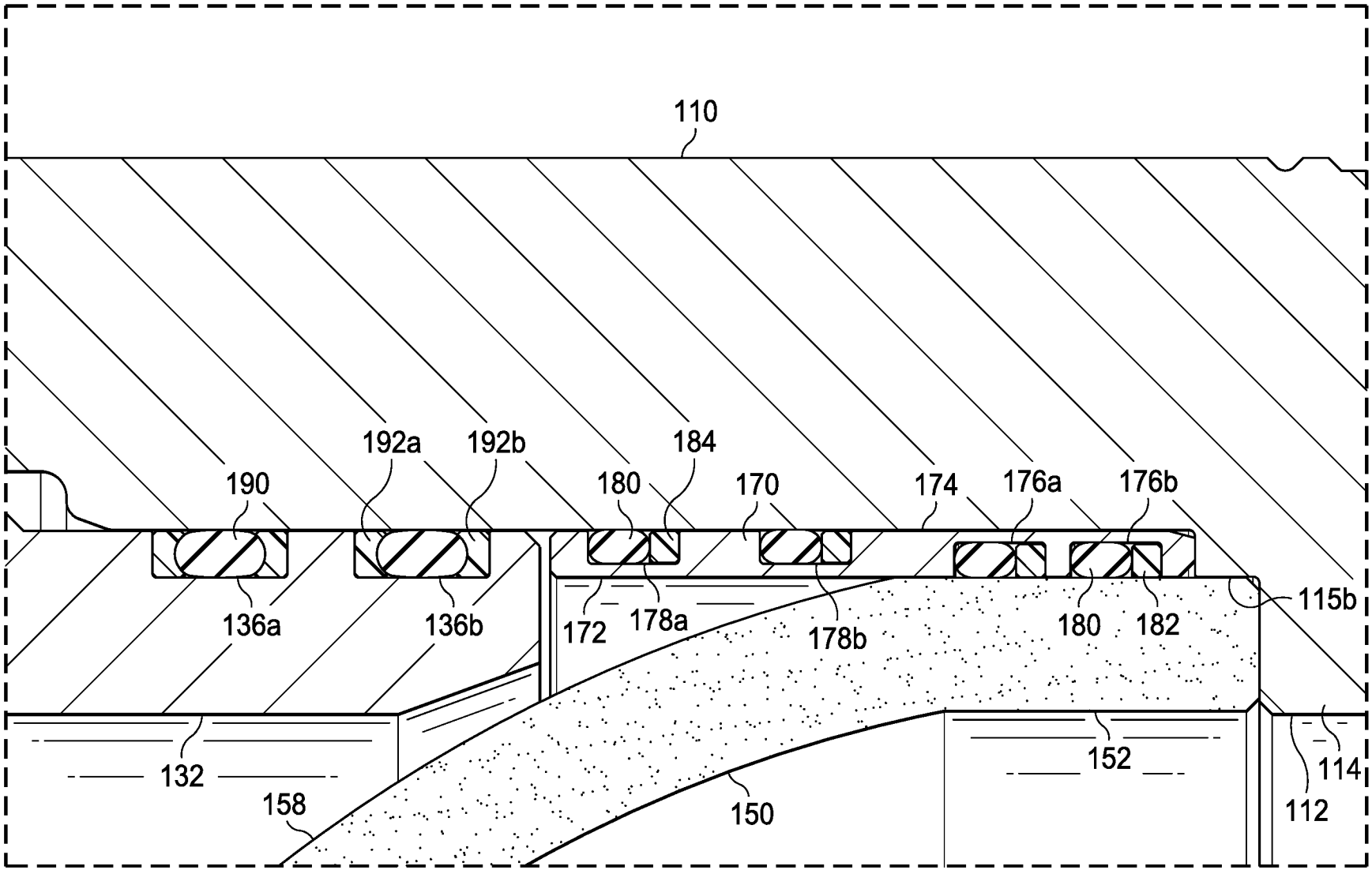
FIG. 1B is a line drawing illustrating a detailed view of another portion of the barrier valve of FIG. 1.

FIGS. 1-1B illustrate an example ceramic disc barrier valve 100 that is high-pressure gas capable. In the illustrated implementations, barrier valve 100 is designed for a 7.00 inch bore. Similar barrier valves may be made for other size bores (e.g., 1.000, 1.250, 1.500, 2.063, 2.375, 2.875, 3.500, 4.000, 4.500, 5.000, 5.500, 6.000, 6.625, 7.000, 7.625, 8.625, 9.625, 9.875, 10.750, 11.750, and 13.375 inches).

Barrier valve 100 includes a housing 102 that is comprised of a central portion 110 coupled to a lower portion 120 and an upper portion 130 by threaded connections. Exterior or interior portions of housing 102 may be threaded for threaded engagement with a casing string, tubing, or other tubular element as set forth in further detail below or as known in the art. Upper portion 130 is the portion closer to the wellbore surface or "uphole." Lower portion 120 is "downhole."

Central portion 120 includes an inner surface 112, lower portion 120 includes an inner surface 122, and upper portion 130 includes an inner surface 132. Inner surface 112, inner surface 122, and inner surface 132, along with various other elements seen in FIG. 1, define a passage 104 through barrier valve 100. In certain modes of operation (i.e., when unblocked), liquid, gas, and/or a combination thereof may pass through barrier valve 100 in passage 104. Central portion 110, lower portion 120, and upper portion 130 also include outer surfaces 113, 124, 134, respectively.

Captured in housing 102 and blocking the passage therethrough in the illustrated implementation are a lower frangible disc 140 and an upper frangible disk 150. Frangible discs are typically made of a ceramic, but may be made of other appropriate materials. Either or both of lower frangible disc 140 or upper frangible disc 150 may block passage 104. Some implementations may only include one of these discs (e.g., lower frangible disc 140). The space in passage 104 above upper frangible disc 150 may be termed "upper passage," and the space below upper frangible disc 150 be termed "lower passage." The terms "up", "down" and similar such terms are self-referential within the barrier only. As is apparent to those with ordinary skill in the art, the described barrier valve may be oriented in different directions relative to the surface when downhole.

Lower frangible disk 140 has a cylindrical portion 142 and an arcuate portion 144. Lower frangible disc 140 also has a first surface 146 and a second surface 148. On arcuate portion 144, first surface 146 is concave relative to a fluid impinging thereon, and second surface 148 is convex relative to a fluid impinging thereon. Arcuate portion 144 is typically ellipsoidal, and in certain implementations, may be spherical (e.g., a hemisphere). Cylindrical portion 142 has a bore therethrough to allow fluid (e.g., liquid and/or gas) to flow to surface 146.

Similarly, upper frangible disk 150 has a cylindrical portion 152 and an arcuate portion 154. Upper frangible disc 150 also has a first surface 156 and a second surface 158. On arcuate portion 154, first surface 156 is concave relative to a fluid impinging thereon, and second surface 158 is convex relative to a fluid impinging thereon. Arcuate portion 154 is typically ellipsoidal, and in certain implementations, may be spherical (e.g., a hemisphere). Cylindrical portion 152 has a bore therethrough to allow fluid (i.e., liquid and/or gas) to flow to surface 156.

In general, frangible discs 140, 150 are manufactured to high tolerances. In particular implementations, the discs are molded and kilned, resulting in a substantially uniform wall section. Then, the outer surface of the cylindrical portions of the discs may be ground to circularity within $_{+}$0.003 inches. In some implementations, after manufacture, the cylindrical portions of the discs may have a total indicated runout (i.e., maximum distance difference between outer surface and inner surface minus minimum distance different between outer surface and inner surface) of less than about 0.045 inches. In other implementations, particularly for smaller discs (e.g., 4.5 inches or smaller), the total indicated runout may be less than about 0.030 inches. In some implementations, particularly for larger discs (e.g., larger than 9.625 inches inches), the total indicated runout may less than about 0.060 inches or 0.075 inches.

In certain implementations, after manufacture, the inner surface and the outer surfaces of the annular portion be concentric to within 0.045 inches. In other implementations, particularly for smaller discs (e.g., 4.5 inches or smaller), the concentricity may be less than about 0.030 inches. In some implementations, particularly for larger discs (e.g., larger than 9.625 inches inches), the concentricity may less than about 0.060 inches or 0.075 inches.

Central portion 110 includes a shoulder 114 that protrudes toward passage 104. Shoulder 114 resists axial movement of lower frangible disc 140 and upper frangible disc 150 through passage 104 once the cylindrical portions 142, 152 of the frangible discs are set thereon.

Also captured in housing 102 are two cartridges 160, 170. Cartridge 160 is located between outer surface 148 of disc 140 and inner surface 112 of central portion 110, and cartridge 170 being is between outer surface 158 of disc 150 and inner surface 112 of central portion 110.

Cartridge 160 has an inner surface 162 and an outer surface 164. Inner surface 162 and outer surface 164 each include two annular grooves 166*a-b*, 168*a-b*, respectively. Inner surface 162 and outer surface 164 may have a tolerance of 0.003 inches or less.

Inserted each annular groove 166 is an elastomeric member 180 (e.g., an O-ring) that provides a seal between outer surface 148 of cylindrical portion 142 of ceramic disc 140 and inner surface 162 of cartridge 160. The elastomeric members 180 may be sized so they compress between about 10%-25% of their width, depending on the gap achieved between inner surface 162 of cartridge 160 and outer surface 148 of cylindrical portion 142 when the barrier valve is assembled (to be discussed in more detail below). The elastomeric members may, for example, be approximately 0.095 inches-0.110 inches in width and be made of a fluoroelastomer (e.g., FFKM or AFLAS from Seals Eastern of Red Bank, New Jersey (USA)).

Also inserted in each of grooves 166 is a backup ring 182. Backup rings 182 prevent elastomeric members 180 from extruding into any gaps between inner surface 162 of cartridge 160 and outer surface 148 of frangible disc 140, which may damage the elastomeric members. Backup rings 182 may have flat or grooved surfaces for engaging the elastomeric members 180.

Backup rings 182 may, for example, be made of a durable, stiff but springy material (e.g., a thermoplastic, such as, for example, polyaryletherketone (PAEK)). In particular implementations, backup rings 182 may be made of polyether ether ketone (PEEK) from Victrex, LLC of Thornton-Cleveleys, Lancashire (UK). The backup rings may also be made from polyetherketoneketone (PEKK), polyamide-imides (PAT), or polyphenylene sulfide (PPS).

In some implementations, the thermoplastic may be filled with a fiber (e.g., a carbon fiber of a glass fiber). The addition of fiber in the thermoplastics reduces shrinking of the backup ring after being exposed to a high temperature environment and then cooled, which can leave the elastomeric members unsupported. The fiber content is typically around 30%, but may range between about 5%-40%.

Backup rings 182 typically extend outside of the grooves slightly (e.g., about 0.002 inches in an uncompressed state). This helps prevent elastomeric members 180 from being extruded into the gap between outer surface 148 and inner surface 162. Only one backup ring is located in each groove 166 because high fluid pressure to be resisted is only expected to penetrate from the outside of frangible disc 140. In other implementations, multiple backup rings (e.g., one on each side of an elastomeric member 180) may be used.

Inserted in annular grooves 168 are elastomeric members 180 (e.g., O-rings) that provide a seal between inner surface 112 of central portion 110 and outer surface 164 of cartridge 160. Also inserted in each of grooves 168 is a backup ring 184. Backup rings 184 prevent the elastomeric members 180 from extruding into any gaps between outer surface 164 of cartridge 160 and inner surface 112 of central portion 110, which may damage the elastomeric members. Backup rings may have a flat or grooved surface for engaging elastomeric members 180. Backup rings 184 may be made of a material similar to backup rings 182. In particular implementations, backup rings 184 may include a cut (e.g., a scarf cut) therethrough.

Backup rings 184 typically extend outside the grooves slightly (e.g., about 0.002 inches in an uncompressed state). This helps prevent elastomeric members 180 from being extruded into the gap between outer surface 164 and inner surface 112. Only one backup ring is located in each groove 168 because high fluid pressure is only expected penetrate from the outside of frangible disc 150. Multiple backup rings may be used, however.

Cartridge 170, which is typically similar to cartridge 160, has an inner surface 172 and an outer surface 174. Inner surface 172 and outer surface 174 each include two annular grooves 176*a-b*, 178*a-b*, respectively.

Inserted each annular groove 176 is an elastomeric member 180 (e.g., an O-ring) that provides a seal between outer surface 158 of annular portion 152 of ceramic disc 150 and inner surface 172 of cartridge 170. The elastomeric members 180 may be sized so they compress between about 10%-25% of their width, depending on the gap achieved between inner surface 172 of cartridge 170 and outer surface 158 of annular portion 152 when the barrier valve is assembled (to be discussed in more detail below). The elastomeric members may, for example, be approximately 0.095 inches-0.110 inches in width and be made of a fluoroelastomer.

Also inserted in each of grooves 176 is a backup ring 182. Backup rings 182 prevent the elastomeric members from extruding into any gaps between inner surface 172 of cartridge 170 and outer surface 158 of frangible disc 150. Backup rings 182 may, for example, be made of a durable, stiff but springy material (e.g., a plastic, such as polyaryletherketone). In particular implementations, backup rings 182 may be made of PEEK. Multiple backup rings may be used in some embodiments.

Inserted in annular grooves 178 are elastomeric members 180 (e.g., O-rings) that provide a seal between the inner surface 112 of central portion 110 and outer surface 174 of cartridge 170. Also inserted in each of grooves 178 is a backup ring 184. Backup rings 184 prevent the elastomeric members from extruding into any gaps between outer surface 174 of cartridge 170 and inner surface 112 of central portion 110. Backup rings 184 may be made of a material similar to backup rings 182. In particular implementations, backup rings 184 may include a cut (e.g., a scarf cut) therethrough. Multiple backup rings may be used in some embodiments.

The elastomeric members may be coated with a high-temperature (e.g., >500 degrees F.) lubricant. In one embodiment, a high viscosity (e.g., 100,000 centistokes) silicone oil, such as Super O-Lube from Parker Hannifin of Cleveland, Ohio (USA) or Pure Silicone Fluid from Clearco Products Willow Grove, Pennsylvania (USA) may be used. As another example, the elastomeric members may by coated with a flouroether-based grease (e.g., Krytox from DuPont of Wilmington, Delaware (USA)) or a perflouropolymer-based grease (e.g., Kluberalpha from Kluber Lubrication of Londonderry, New Hampshire (USA)). The lubricant penetrates small-sized imperfections (e.g., in the micron range) in a ceramic disc and helps seal against fluid passage.

Outer surface 124 of lower housing 120 also has grooves 126 therein. These grooves receive elastomeric members 190 (e.g., O-rings) to create a seal between inner surface 112 of central portion 110 and outer surface 124 of the lower housing. Grooves 126 also contain backup rings 192, two rings in each groove in this implementation. Two backup rings are typically used in these grooves because they can be exposed to fluid pressure differentials from either direction. The backup rings typically extend out of the grooves a slight amount (e.g., 0.002 inches) to assist in preventing extrusion of the elastomeric members. Backup rings 192 may be made of a similar material as backup rings 184.

Similarly, outer surface 134 of upper housing 130 has grooves 136 therein. These grooves also receive elastomeric members 190 (e.g., O-rings), to create a seal between inner surface 112 of central portion 110 and outer surface 134 of the upper housing. Grooves 136 also contain backup rings 192, two rings in each groove in this implementation.

To obtain a close fit, in certain embodiments, a diametric gap of ≤ about 0.009 inches between the outer surface of the cylindrical portion of the ceramic discs and the inner surface of the cartridge, careful, and expensive, grinding of the ceramic discs is needed to make them very nearly round, preferably within a diameter tolerance of +0.003 inches. The cartridges similarly preferably have very tight tolerances on their inner diameters (e.g., +0.003 inches). With a designed gap of 0.003 inches between the outer surface of the frangible discs and the inner surface cartridge, this provides a maximum gap of about 0.009 inches. This close fit, together with the described elastomeric members 180 and viscous lubricant, permit the described barrier valve to resist liquid and gas penetration between the ceramic disc/cartridge and the cartridge/housing interfaces at substantial pressures (e.g., 10,000-20,000 psi). In certain implementations, the frangible disc and the cartridge may have a tolerance of +0.0025 inches. In particular implementations, the diametric gap may be ≤ than about 0.006 inches.

It is believed that a more preferable ceramic disc diameter tolerance is +0.002 inches. It is believed that a useful diameter tolerance is up to +0.006 inches. It is believed that a more preferable cartridge inner diameter and outer diameter tolerance is +0.002 inches. It is believed that a useful cartridge inner diameter and outer diameter tolerance is up to +0.006 inches. It will be appreciated by those with ordinary skill in the art that barrier valves intended for operation in the face of lower pressures may usefully have larger ceramic disc/cartridge and cartridge/housing clearances and correspondingly larger elastomeric members to fill the larger clearances.

Close fits may also be achieved between the outer surfaces of the cartridges and the inner surface of central portion 110 and between the inner surface of the central portion and the outer surfaces of lower housing 120 and upper housing 130. For example, the surfaces may be designed such that they preferably have a clearance of about 0.003 inches to about 0.009 inches. It is believed that a useful maximum clearance is about 0.02 inches. It is believed that a most preferable clearance is about 0.002 inches.

The housing similarly preferably has very tight tolerances on its inner diameters (e.g., 3 0.003 inches). It is believed that a more preferable housing inner diameter tolerance is +0.002 inches. It is believed that a useful housing inner diameter tolerance is up to +0.006 inches.

It is believed that in particular implementations, the extremely tight clearance between a frangible disc and a cartridge, the extremely tight clearance between the cartridge and the inner surface of the housing, the elastomeric members' obstruction of lubricant flow through the disc/cartridge and the cartridge/housing gaps, the surface tension between the viscous lubricant and the close ceramic disc, cartridge and housing surfaces, and the high resistance of the high viscosity lubricant within these structures synergistically act together to help make the tight disc/cartridge and cartridge/housing gaps impenetrable to gas even at very high pressures. It is believed that the lubricant additionally seals the interface of the bottom of the frangible disc and the radial and axial portions of shoulder 115 and between the bottom of the cartridge and the radial portion of shoulder 115, as well as additionally sealing the interfaces between the skirt and the cartridge and the cartridge and the inner housing against gas penetration. It is believed that lubricants with a viscosity in the range of 50,000 centistokes to 125,000 centistokes help achieve this result. Some embodiment may not use a lubricant and still achieve similar results.

Barrier valves may be rated based on the maximum pressure, maximum temperature, and fluid (e.g., liquid or gas) that they can hold. The most widely used standard is ISO 14310 (equivalent to API 11D1), which allows valves ratings from V6-V0. A summary of the valve ratings effective as of the filing date of this application appears below.

| Rating | Test Fluid | Test Summary |
|---|---|---|
| V6 | Liquid/Gas | Manufacturer-defined test procedure. |
| V5 | Liquid (e.g., water) | Test at max rated differential pressure and max rated temperature with a min of two pressure reversals. No more than 1% pressure reduction over each hold period. |
| V4 | Liquid (e.g., water) | V5 plus axial load test (if applicable) |
| V3 | Liquid (e.g., water) | V4 plus test at least one temperature cycle (from max temperature to min temperature and back). |
| V2 | Gas (e.g., air) | V3 plus test at max rated differential pressure and max rated temperature with a min of two pressure reversals. No more than 20 $cm^3$ gas bypass allowed over each hold period. Also perform axial load test (if applicable). |
| VI | Gas (e.g., air) | V2 plus test at least one temperature cycle (from max temperature to min temperature and back). |
| VO | Gas (e.g. air) | VI with modification that zero gas bypasses during each hold. |

The hold period is 15 minutes.

Barrier valve 100 is capable of achieving a V0 rating according to ISO 14310 at 10,000 psi and 350 degrees F. Barrier valve 100 is also capable of achieving a V0 rating at 10,000 psi and 400 degrees F. Additionally, barrier valve 100 is capable of achieving a V0 rating at 15,000 psi and 350 degrees F. Barrier valve 100 is further capable of achieving a V0 rating at 15,000 psi and 400 degrees F. Barrier valve 100 is believed capable of achieving a V0 rating at 15,000 psi and 600 degrees F. or a V0 rating at 20,000 psi and 400 degrees F. In each of these listed instances, zero gas bubbles bypass the barrier valve at the stated pressures, temperatures, and times. For clarification, the described barrier valve, being capable of achieving a V0 rating under these conditions, is additionally capable of achieving each of the described V6-V1 ratings under the same, similar and less harsh conditions and parameters.

Although representative of a barrier valve, barrier valve 100 may be particularly useful as a 7.000 inch barrier valve. In such implementations, the diameter of the passage 104 may about 7 inches, and the length of the barrier valve may be about 35 inches long.

During one mode of assembly, frangible discs 140, 150 are inserted into central portion 110 one at a time. First, a disc is greased with lubricant. Then, the disc is inserted annular portion inward into central section 110. Interfacing the bottom of the disc with edge 115 of shoulder 114 and spinning the disc usefully tests whether the disc is fully and properly inserted and is resting flat on shoulder 114. For example, if the disc spins freely within the housing without outward oscillation, then its annular portion is resting flat on shoulder 114. Once the disc is resting flat on shoulder 114, the associated cartridge may be installed. Installation of the cartridge may begin by greasing the interior and exterior sides with the lubricant, installing the elastomeric members and the backup rings and then hand-inserting the cartridge until it engages the ceramic disc (near the juncture of the cylindrical portion and the arcuate portion of the disc). After this, a mounting tool may be carefully used to force the distal portion of the cartridge between the inner surface 112 of the central portion 110 and the outer surface of the annular portion of the frangible disc. Once one frangible disc is installed, the other may be installed in a similar manner.

During operation, a pressure may be applied to the outer surface of frangible disc 140, and another pressure may be applied to the outer surface of frangible disc 150. At pressures and temperatures below the maximum ratings (e.g., 15,000 psi and 400 degrees F.), the frangible discs, cartridge, and their seals prevent fluid (e.g., liquid and gas) from penetrating. Breaking one of frangible discs, typically frangible disc 150, by increased fluid pressure or physical device (e.g., a go devil), will result in a pressure surge that will break apart the rest of the frangible disc. The pressure surge will typically break the other frangible disc since it will impinge on that disc's inner surface, which holds less pressure than the outer surface. The rest of the other frangible disc will then break apart, leaving passage 104 relatively clear.

Using a cartridge to provide sealing between a frangible disc and the housing provides substantial advantages. As the cartridges are metallic, mechanical parts, they may be machined to high tolerances (e.g., +0.003 inches). Thus, the inner surface of the cartridges may be made to closely match the outer surface of the annular portion of the ceramic discs and allow smaller elastomeric members than would be required if trying to mount the ceramic discs in the housing alone. Because the frangible discs are somewhat brittle, they should not be roughly handled, mounted with excessive force, or mounted while misaligned. Mounting the frangible discs in the precisely-machined cartridges as described herein, helps alleviate these assembly problems.

Placing the retaining grooves in the cartridges, as opposed to placing them in the barrier valve's other components (e.g., the housing or the ceramic disc), provides substantial improvements, particularly in strength and size ratio. Placing a retaining groove into the housing, for example, could weaken it in burst or collapse when under extreme pressure or tension. Since this is typically the weak link to the entire tool, the outer diameter of the housing would have to be made larger to account for this to achieve an equivalent pressure rating. Placing a retaining groove in the frangible disk would create a structural weakness and stress concentrator in the ceramic disc, increasing the likelihood that the frangible disc will fail at a lower load than would a similar disk without such a groove.

In certain modes of operation, cartridges 160 will physically deform before allowing fluid to flow around the seals. In some embodiments and environments, as fluid pressure is increased on the barrier valve, the portion of a cartridge containing the outer grooves will be compressed against the inner wall of central portion 112 due to the inner surface of the cartridge being impinged upon radially outward by the fluid, resulting in a tighter seal on the cartridge's outer elastomeric members with the inner diameter of the housing. As fluid pressure on the barrier valve is increased, a sufficient axial force on the narrow exposed rim of the cartridge may cause the cartridge to buckle axially, inward toward the frangible disc. It is believed the cartridge's inner grooves weaken the inner axial layer of the cartridge relative to the outer axial layer of the cartridge, which may contribute to this effect. It is believed that because of the force on the exposed upper and inner surfaces of the cartridge, the cartridge buckles by the distal portion of the cartridge, moving the cartridge towards the frangible disc, creating a tighter seal with the inner elastomeric members against the disc. Thus, is believed that as pressure increases, the sealing capacity of the barrier valve 100 increases.

Although FIG. 1 illustrates an example barrier valve, other barrier valves may have different configurations. For example, a barrier valve may be resized depending on the size of tubing with which it will interface. Additionally, the outer surface of the frangible disc's annular portion may have a surface finish of 63 micro inches (rms). It is believed that a surface finish on the outer surface of the annular portion provides a better sealing surface for the elastomeric members and viscous lubricant to create a barrier against very high-pressure gas and helps protect against wear and tear on the elastomeric seals during pressure and temperature cycles. In certain implementations, the finish may be 32 (e.g., by polishing or honing). In some embodiments, a barrier valve may have only one elastomeric member at each sealing interface, or two grooves/elastomeric members between the disc and the cartridge and one groove/elastomeric member between the cartridge and the inner surface of the housing, or vice versa. In a preferred embodiment, a second groove/second elastomeric member within the disc/cartridge interface and the cartridge/housing interface provides useful additional reliability against very high-pressure gas seepage through a first groove/first elastomeric member seal. In particular implementations, only one frangible disc may be used.

Figure 2:
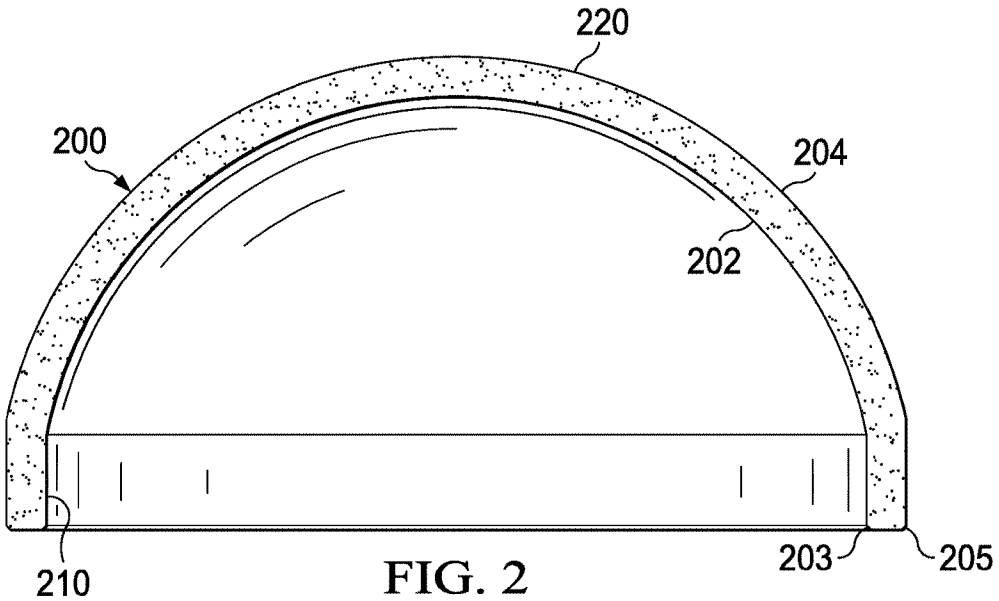
FIG. 2 is a line drawing illustrating an example ceramic disc.

FIG. 2 illustrates a detailed view of an example frangible disc 200 for a barrier valve. As discussed for barrier valve 100, frangible disc 200 includes an annular portion 210 and an arcuate portion 220. The disc also includes an inner surface 202 and an outer surface 204. The distance between the inner surface and the outer surface is fairly uniform over the disc (e.g., about 0.31 inches in certain implementations). In particular implementations, the distance between the inner surface and outer surface can vary by 0.045 inches in total indicated runout.

Inner surface 202 has a chamfer 203 at its end, and outer surface 204 has a chamfer 205 at its end. The chamfer may range between about 30 degrees and 60 degrees, and is about 45 degrees as illustrated.

Although representative of a frangible disc, in particular implementations, disc 200 may be useful in a 7.0 inch tool. In these implementations, disc 200 may have an entire height of about 3.7 inches, and a total width is about 7.0 inches. The height of annular portion 210 may be about 0.73 inches. The inner radius of arcuate portion may be about 3.2 inches, and the outer radius may be about 3.6 inches.

In particular implementations, the outer surface 204 of annular portion 210 may be ground to a very exact dimension (e.g., 6.9835 inches±0.0015 inches). The inner surface 202 may be 6.366 inches±0.090 inches.

Actuate portion 320 is spherical in shape, but not quite a complete a hemisphere. The angle between the tangent lines of the respective portions at the juncture of the annular portion and the arcuate portion is about 18 degrees.

Although FIG. 2 illustrates an example frangible disc, other frangible discs may have other configurations. For example, similar frangible discs may be made for various size tools (e.g., 2.375, 2.875, 3.5, 4.5, 7.000, 9.625, or 13.375 inches), which would consequently affect the sizing of the frangible disc. Additionally, the annular portion may have differing height proportions relative to the height of the arcuate portion. Furthermore, the angle between the tangent lines at the juncture of the annular portion and the arcuate portion may vary between 16 degrees and 20 degrees, and in some cases may be as low as 12 degrees.

Figure 3:
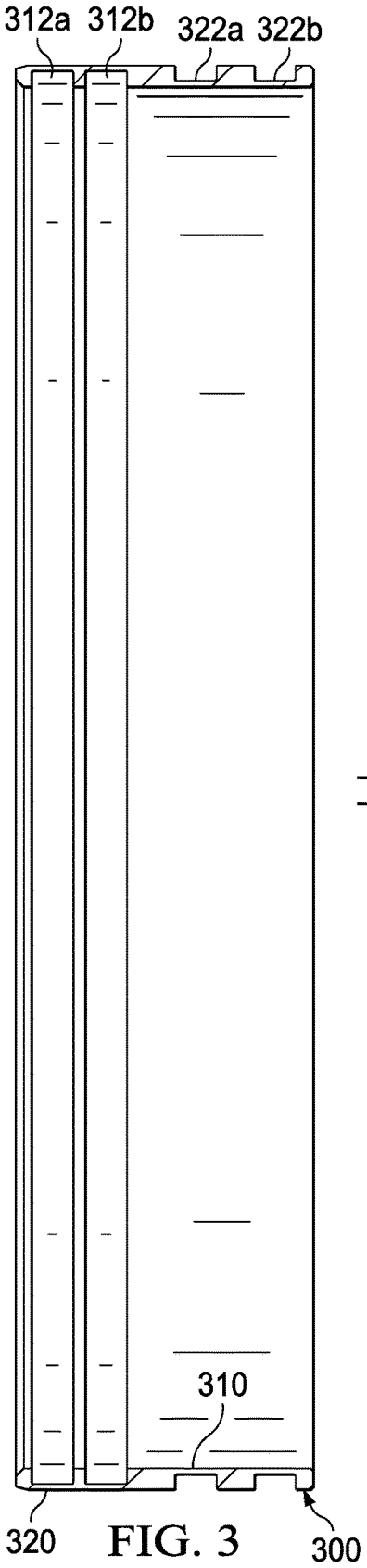
FIG. 3 is a line drawing illustrating an example cartridge.

FIG. 3 illustrates an example cartridge 300 for a barrier valve. As discussed for barrier valve 100, cartridge 300 is an annular ring that includes an inner surface 310 and an outer surface 320. Inner surface 310 includes two grooves 312 therein, designed to receive elastomeric members and backup rings. Similarly, outer surface 320 includes two grooves 322 therein, designed to receive elastomeric members and backup rings.

Although representative of a cartridge, cartridge 300 may be reconfigured for other implementations. In particular implementations, cartridge 300 may be approximately 7.2 inches in outer diameter, 7.0 inches in inner diameter, and 1.5 inches in height. The distance between the inner surface 310 and the outer surface 320 may be about 0.11 inches, and the grooves may be about 0.08 inches deep and 0.21 inches in width. With an expected gap of around 0.003 inches and a maximum gap of about 0.009 inches to the next mating surface, elastomeric members with a width of about 0.103 inches may be used. This would allow the elastomeric members to stick out beyond the surfaces approximately 0.023 inches. When the gap is at its minimum (e.g., 0.003 inches), the elastomeric members will be compressed about 20% in width. When the gap is at its maximum (e.g., 0.009 inches), the elastomeric members will be compressed about 13% in width.

Cartridge 300 may be made of metal or any other appropriate material. For example, cartridge 300 may be made of stainless steel of a nickel alloy. In some implementations, cartridge 300 may be coated (e.g., in phosphate and oil). Cartridge 300 may have a surface finish of 63 micro inches (rms) or better.

Figure 4:
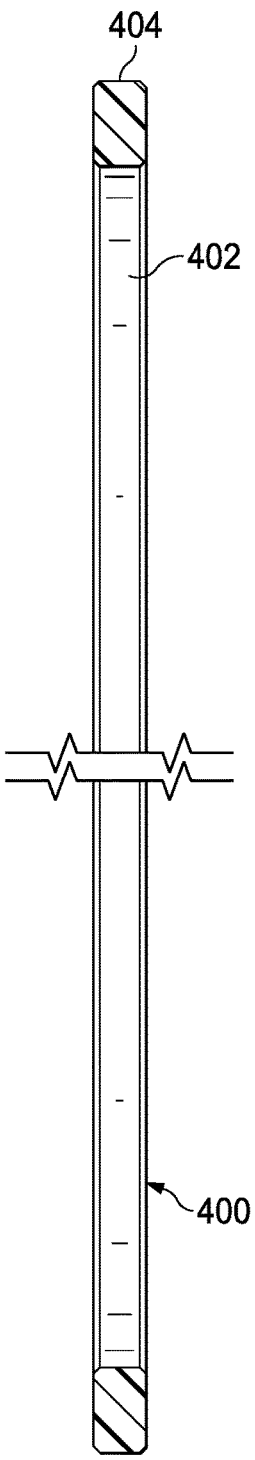
FIG. 4 is a line drawing illustrating an example backup ring.

FIG. 4 illustrates an example backup ring 400 for a barrier valve. Backup ring 400 is generally annular in shape and has an inner surface 402 and an outer surface 404, which are generally flat. As illustrated, backup ring 400 is sized to fit in an inner groove in cartridge 300. Backup ring 400 may be sized differently for other configurations of barrier valves.

In particular implementations, inner surface 402 may have a radius of about 7.0 inches, outer surface may have a radius of about 7.1 inches, and the ring may be about 0.65 inches thick. Backup ring 400 is typically sized so that it will stick out slightly from a cartridge in which is it inserted (e.g., about 0.004 inches). Depending on the tolerance stack-up, however, it may be slightly below the cartridge's surface (e.g., 0.002 inches).

Figure 4A:
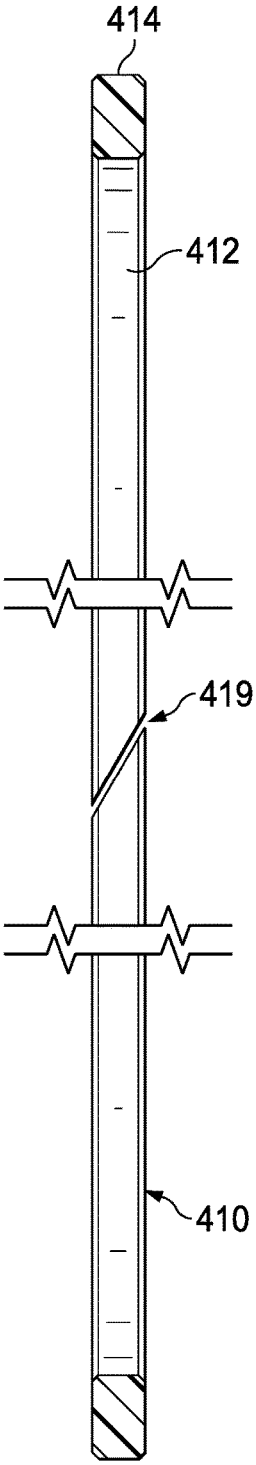
FIG. 4A is a line drawing illustrating another example backup ring.

FIG. 4A illustrates another example backup ring 410 for a barrier valve. Backup ring 410 is generally annular in shape and has an inner surface 412 and an outer surface 414. As illustrated, backup ring 410 is sized to fit in an outer groove in cartridge 300. Backup ring 410 may be sized differently for other configurations of barrier valves.

In particular implementations, inner surface 412 has a radius of about 7.1 inches, outer surface has a radius of about 7.2 inches, and the ring is about 0.65 inches thick. Backup ring 410 is typically sized so that it will stick out slightly from a cartridge in which is it inserted (e.g., about 0.001 inches on the average, but ranging up to 0.004 inches). Depending on the tolerance stack-up, however, it may slightly be below the cartridge's surface (e.g., 0.002 inches).

Backup ring 410 has a cut 419 through it. The cut may be about 0.004 inches in width, ranging up to about 0.008 inches, and be made at an angle of between 45 degrees and 75 degrees. Cut 419 assists in fitting backup ring over/around structures before a groove. As backup ring 420 is made of a hard plastic, it does not stretch easily. When compressed by the elastomeric members, the backup rings will snap out to block of the gap between the cartridge and the adjacent element.

Figure 4B:
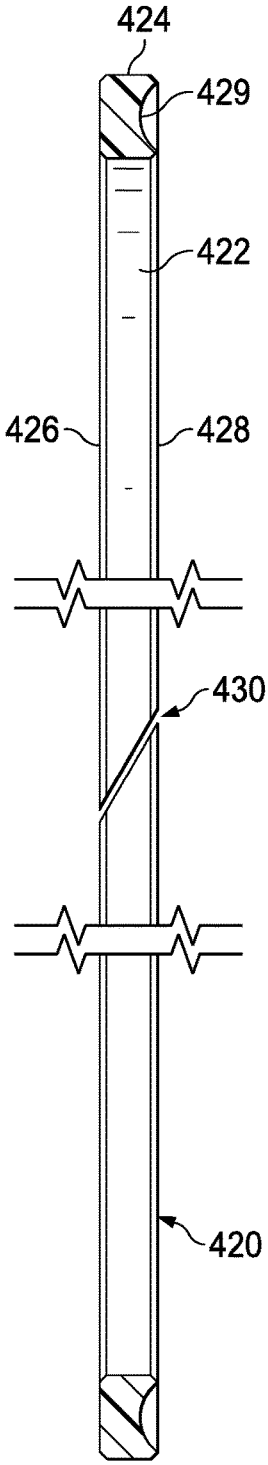
FIG. 4B is a line drawing illustrating an additional example backup ring.

FIG. 4B illustrates an additional example backup ring 420 for a barrier valve. Backup ring 420 is generally annular in shape and has an inner surface 422 and an outer surface 424. As illustrated, backup ring 420 is sized to fit in an outer groove in upper housing portion 130. Backup ring 420 may be sized differently for other configurations of barrier valves. Moreover, similar backup rings may be used in a cartridge's grooves.

Backup ring 420 also includes a first face 426 and a second face 428. First face 426 is relatively flat and may be placed next to a groove in a metal component (e.g., a housing or cartridge). Second face 428, however, has a groove 429. Groove 429 may be sized to match an elastomeric member against which second face 428 will be placed.

Groove 429 is thought to enhance performance by allowing applied pressure to act on the curved surface such that the backup ring is pressed up and into the extrusion gap, instead of the elastomeric member, as well as allowing the backup ring to better support the curved surface of the elastomeric member with less deformation, as compared to a flat backup ring.

In particular implementations, inner surface 422 may have a radius of about 7.0 inches, outer surface 404 may have a radius of about 7.2 inches, groove 429 may have a radius of curvature of 0.055 inches and a depth of about 0.0495 inches, and backup ring may be about 0.72 inches thick. Backup ring 420 is typically sized so that it will stick out slightly from a housing component in which is it inserted (e.g., about 0.001 inches on the average, but ranging up to 0.004 inches).

Backup ring 420 has a cut 430 through it. The cut may assist in installing backup ring 420 in an outer groove. The cut may be about 0.004 inches in width (ranging up to about 0.008) and be made at an angle of between 45 degrees and 75 degrees. When compressed by the elastomeric members, the backup rings will snap out to block of the gap between the cartridge and the adjacent element.

In particular implementations, backup rings similar to backup ring 420 may be used in multiple one or more grooves in a cartridge. In some implementations, all of the backup rings in a barrier valve may be similar to backup ring 420 (e.g., having a facial groove).

Figure 5:
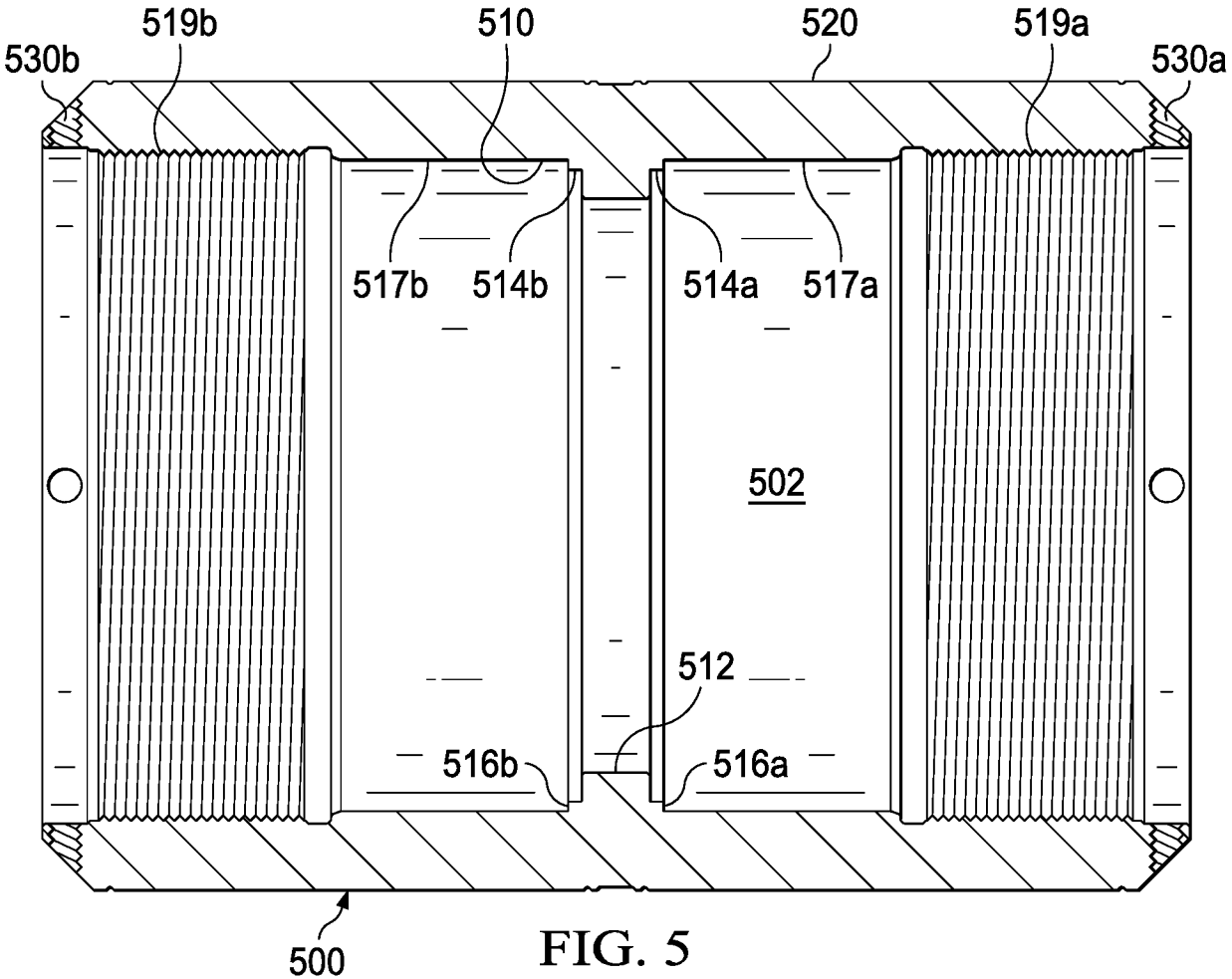
FIG. 5 is a line drawing illustrating an example central housing portion.

FIG. 5 illustrates an example central portion 500. Similar to central portion 110, central portion 500 includes an inner surface 510 and an outer surface 520. Inner surface 510 generally defines a passage 502 through central portion 510, and in operation, fluid (i.e., liquid and/or gas) may flow within passage 502. In various modes of operation, however, passage 502 may be blocked with one or more frangible discs.

Inner surface 510 has a shoulder 512 configured to resist axial movement of a frangible disc located on one side thereof or respective frangible discs located on both sides thereof. Shoulder 512 includes sides 514 extending perpendicular outward from the shoulder (in the axial direction). Sides 514 allow frangible discs to be easily centered during assembly. At the distal ends of sides 514 are a set of shoulders 516. Shoulders 516 provide a stop for a cartridge, which is typically a thin, annular ring made of metal (e.g., stainless steel), as it is being inserted between the inner surface 510 and a previously inserted frangible disc.

Inner surface 510 includes relatively flat surfaces 517 extending axially away from shoulders 516. Surfaces 517 provide a place for elastomeric members on the outside of a cartridge to seal between the cartridge and inner surface 510 and may also provide a place for elastomeric members on the outside of a housing portion to seal between the housing portion and inner surface 510.

Inner surface 510 also includes threads 519. Threads 519*a* may, for example, interface with threads of a lower housing portion, and threads 519*b* may interface with threads of an upper housing portion.

Extending between inner surface 510 and outer surface 520 are channels 530. As illustrated, channels 530 are threaded to receive a screw, which can be used to secure interfacing housing portions in place.

Central portion 500 may be made of metal (e.g., alloy steel) or any other appropriate material. In particular implementations, inner surface 510 may be coated (e.g., with copper plate).

Although representative of a central portion, central portion 500 may be reconfigured for different sized tools. In particular implementations, central portion 500 may be about 12.7 inches long and about 8.25 inches in outer diameter. Additionally, shoulder 512 may be about 6.4 inches in diameter and extend about 0.42 inches into passage 520 from surfaces 517, and shoulder 516 may extend about 0.11 inches into passage 502 from surfaces 517. Surfaces 517 may be about 7.2 inches in diameter and about 2.5 inches in length.

Figure 6:
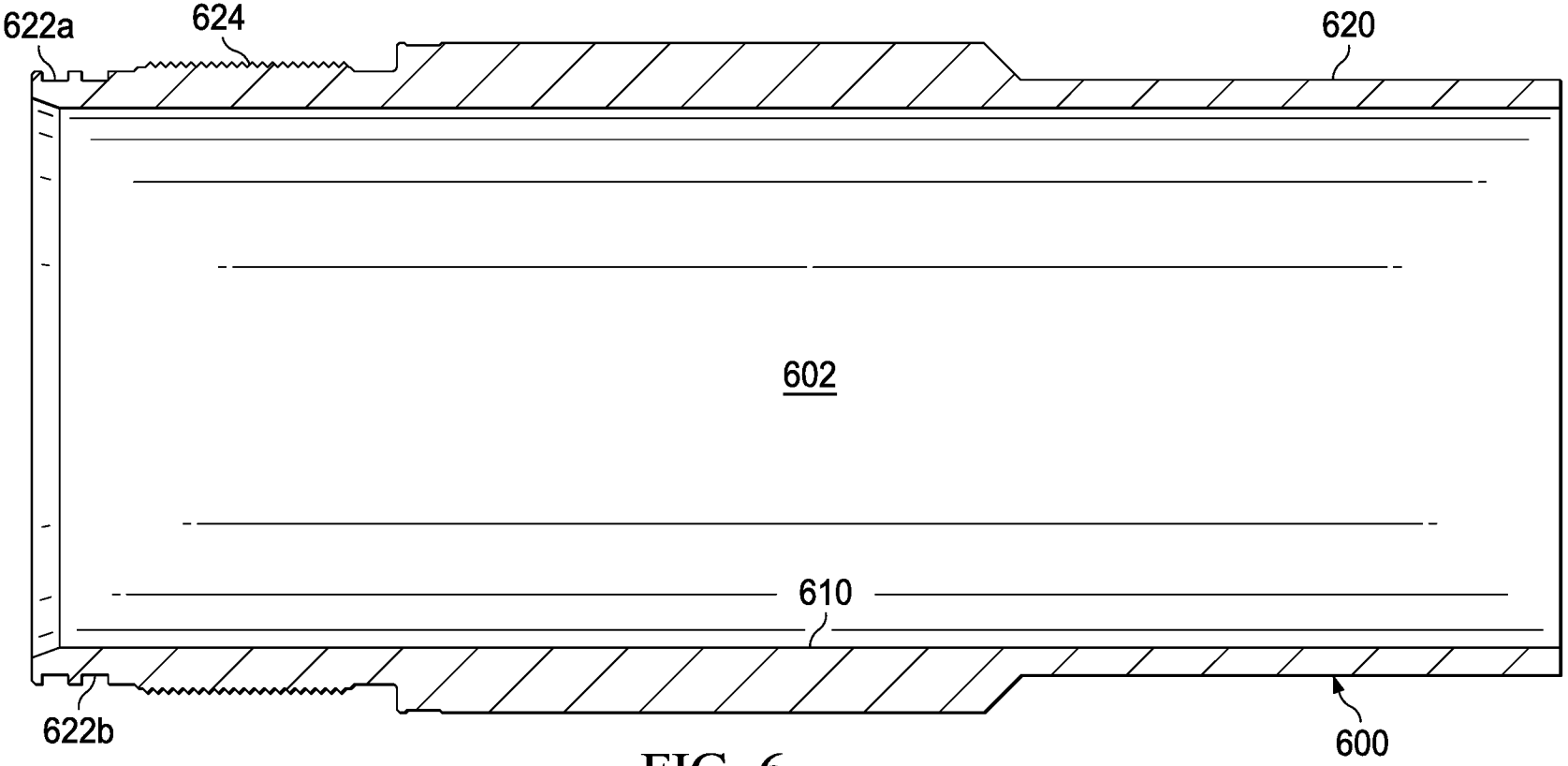
FIG. 6 is a line drawing illustrating an example lower housing portion.

FIG. 6 illustrates an example lower housing portion 600 for a barrier valve. Lower portion 600 may, for example, interface with a central housing portion like central portion 500.

Lower portion 600 includes an inner surface 610 and an outer surface 620. Inner surface 610 defines a passage 602 through lower portion 600, and in operation, fluid (i.e., liquid and/or gas) may flow within passage 602, unless blocked by a frangible disc.

Outer surface 620 includes grooves 622 for receiving elastomeric members (e.g., O-rings) and possibly backup rings. Outer surface 620 also includes threads 624 for securing lower housing portion 600 to another housing component (e.g., central portion 500).

Although representative of a lower housing portion, lower housing portion 600 may be reconfigured for different sized tools. In particular implementations, lower housing portion may be about 18.0 inches long, about 7.2 inches in outer diameter (at the grooved end), and about 6.3 inches in inner diameter. Grooves 622 may be about 0.31 inches wide and 0.11 inches deep.

For implementations in which an expected gap between the outer surface and another housing component is expected to be between 0.003 inches and 0.009 inches, an elastomeric member with a diameter of around 0.139 inches may be used. Thus, when the minimum gap occurs, the elastomeric member may be compressed about 25% and when the maximum gap occurs, the elastomeric member may be compressed about 21%.

Figure 7:
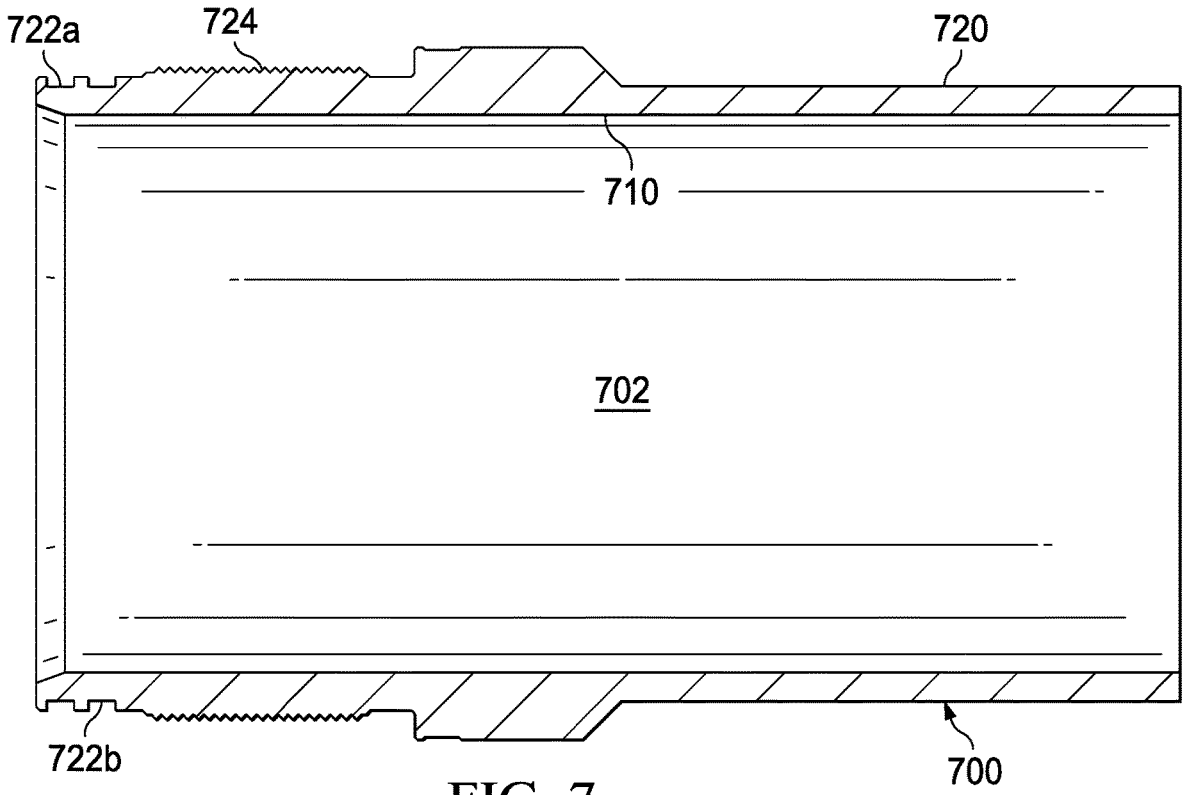
FIG. 7 is a line drawing illustrating an example upper housing portion.

FIG. 7 illustrates an example upper housing portion 700 for a barrier valve. Upper portion 700 may, for example, interface with a central housing portion like central housing portion 500.

Upper housing portion 700 includes an inner surface 710 and an outer surface 720. Inner surface 710 defines a passage 702 through upper portion 700, and in operation, fluid (i.e., liquid and/or gas) may flow within passage 702, unless blocked by a frangible disc.

Outer surface 720 includes grooves 722 for receiving elastomeric members (e.g., O-rings) and possibly backup rings. Outer surface 720 also includes threads 724 for securing housing portion 700 to another housing component (e.g., central portion 500).

Although representative of an upper housing portion, upper housing portion 700 may be reconfigured for different sized tools. In particular implementations, upper housing portion 700 may be about 13.0 inches long and about 7.2 inches in outer diameter (at the grooved end), and about 6.3 inches in inner diameter. Grooves 622 may be about 0.31 inches wide and 0.11 inches deep. Grooves 722 are approximately 0.100 inches in depth. For implementations in which an expected gap between the outer surface and another housing component is expected to be between 0.003 inches and 0.009 inches, an elastomeric member with a diameter of around 0.139 inches may be used. Thus, when the minimum gap occurs, the elastomeric member may be compressed about 25% and when the maximum gap occurs, the elastomeric member may be compressed about 21%.

Figure 8:
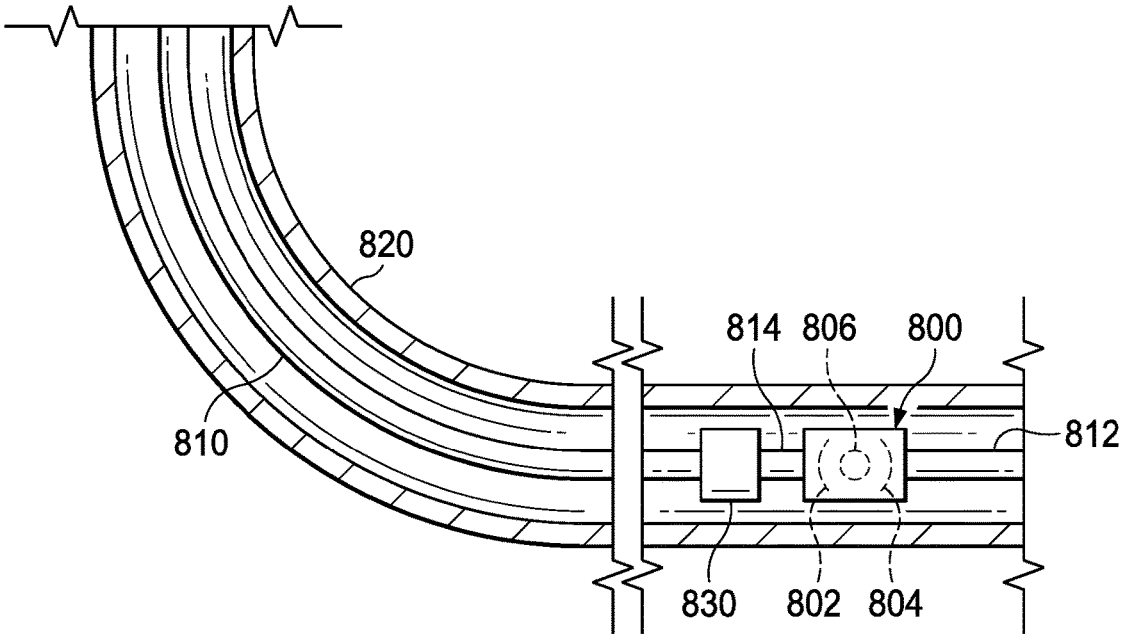
FIG. 8 is a line drawing illustrating an example barrier valve in use.

FIG. 8 illustrates an example use of a barrier valve 800. As illustrated, barrier valve 800 may be part of a horizontal or inclined section of a production string 810 inside a casing string 820 that intersects a productive zone, where one or more pipe joints 812 may be disposed below the valve and a series of pipe joints 814 may be disposed above the valve, leading to the surface or well head so formation fluids may be produced. A typical use of the valve is to isolate the productive zone below a packer 830 from pressure operations above the valve, which operations typically set the packer. Because of the inherent strength of the convex side of the illustrated upper frangible disc 802, the applied pressure may be sufficiently high to conduct any desired pressure operation. Another typical use of the valve is in setting a liner during drilling of a deep well.

Typically at the outset and throughout the packer setting operation, there is hydrostatic pressure inside production string 810 and in the annulus between the production string and casing string 820, meaning there is hydrostatic pressure above upper disc 802 and below the lower frangible disc 804. Packer 830 is set by applying pressure downwardly through production string 810. So long as the packer is set by a pressure that is less than the strength of disc 802 against pressure applied on the convex side, the packer may be manipulated without fracturing the upper disc.

After packer 830 is set, pressure is applied from above. This applied pressure exceeds the ability of the convex side of upper disc 802 to withstand it. The upper disc then shatters or ruptures allowing tubing pressure to enter the area 806 between the discs. This pressure will also shatter lower disc 804, thereby placing production string 810, above and below the valve 800, in communication and allowing the well to produce. Thus, barrier valve 860 allows breaking of the discs 802, 804 to place the heretofore isolated parts of the well in communication by the application of pressure from above.

The use of the terms "a" and "an" and "the" and similar referents in the context of describing the invention (especially in the context of the following claims) are to be construed to cover both the singular and the plural, unless otherwise indicated herein or clearly contradicted by context. As used herein, the term "a" includes at least one of an element that "a" precedes, for example, "a device" includes "at least one device." "Or" means "and/or." Further, it should further be noted that the terms "first," "second," and the like herein do not denote any order, quantity (such that more than one, two, or more than two of an element can be present), or importance, but rather are used to distinguish one element from another. The modifier "about" used in connection with a quantity is inclusive of the stated value and has the meaning dictated by the context (e.g., it includes the degree of error associated with measurement of the particular quantity).

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits, and ranges may appear in one or more claims below. All numerical values are "about" or "approximately" the indicated value, and take into account experimental error and variations that would be expected by a person having ordinary skill in the art. Where such experimental error and expected variations are not determinable according to the person having ordinary skill in the art standard, then "about" or "approximately" numerical values are defined to include a plus or minus 10% of the stated absolute numerical value.

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R.sub.l, and an upper limit, R.sub.u, is disclosed, any number falling within the range is specifically disclosed. In particular, the following numbers within the range are specifically disclosed: R=R.sub.l+k*(R.sub.u−R.sub.1), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

Use of broader terms such as comprises, includes, and having should be understood to provide support for narrower terms such as consisting of, consisting essentially of, and comprised substantially of.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The invention has been described with reference to various particular implementations, and several others have been mentioned or suggested. Moreover, those skilled the art will readily recognize that a variety of additions, deletions, substitutions, and transformations may be made to the disclosed implementations while still achieving a gas capable ceramic disc barrier valve. Thus, the scope of protection should be judged based on the claims below, which may encompass one or more concepts of one or more embodiments. Each and every claim is incorporated as further disclosure into the specification, and the claims are embodiment(s) of the present invention.

The invention claimed is:

1. A barrier valve comprising:

a housing having an outer surface and an inner surface, the inner surface defining a passage through the barrier valve and having a diameter;

an annular cartridge sized to fit concentrically within the passage, the cartridge having an outer surface and an inner surface;

a frangible disc composed of a ceramic material and comprising an annular portion sized to fit concentrically within the annular cartridge and a curved portion that extends outward from one end of the annular portion to block the flow of fluid therethrough, the annular portion having an outer surface with a surface roughness of less than 64 micro inches (rms);

a first elastomeric member between the outer surface of the cartridge and the inner surface of the housing;

a second elastomeric member between the outer surface of the annular portion of the frangible disc and the inner surface of the cartridge; and a viscous lubricant on the outer surface of the second elastomeric member such that the lubricant penetrates imperfections in the frangible disc in at least the vicinity of the second elastomeric member;

wherein the barrier valve prevents the flow of gas in a direction through the passage for a duration of 15 minutes at a pressure of 10,000 psi and a temperature of 350 degrees F. when the frangible disc, the cartridge, and the elastomeric members are mounted therein;

wherein the lubricant is an oil with a viscosity between 50,000 centistokes and 125,000 centistokes.

2. The barrier valve of claim 1, wherein the annular portion of the frangible disc has a total indicated runout of less than 0.045 inches between its inner and outer surfaces.

3. The barrier valve of claim 1, wherein the barrier valve further prevents the flow of gas in the direction through the passage for a duration of 15 minutes at a pressure of 15,000 psi and a temperature of 400 degrees F.

4. The barrier valve of claim 1, wherein the barrier valve further prevents the flow of gas in the direction through the passage at a temperature of 80 degrees F. and a pressure of 10,000 psi for a duration of 15 minutes.

5. The barrier valve of claim 1, wherein the annular portion has an outer diameter that is within 0.012 inches of the diameter of the inner surface of the cartridge.

6. The barrier valve of claim 1, wherein:

the cartridge comprises a groove in its outer surface for receiving and retaining the first elastomeric member and a first backup ring between the outer surface of the cartridge and the inner surface of the housing; and the cartridge comprises a groove in its inner surface for receiving and retaining the second elastomeric member and a second backup ring between the outer surface of the frangible disc and the inner surface of the cartridge, the backup rings configured to respectively resist the elastomeric members extruding into gaps between the outer surface of the cartridge and the inner surface of the housing and between the inner surface of the cartridge and the outer surface of the frangible disc.

7. The barrier valve of claim 6, wherein each backup ring comprises a first surface and a second surface, the first surface being flat and the second surface having an arcuate groove for receiving one of the elastomeric members.

8. The barrier valve of claim 7, wherein the backup rings extend outside each groove between −0.001 inches and 0.003 inches before compression.

9. The barrier valve of claim 6, wherein the elastomeric members extend at least 0.023 inches outside the surfaces of the annular cartridge in an uncompressed state.

10. The barrier valve of claim 1, wherein the frangible disc is held in the housing such that a pressure differential across the curved portion of the frangible disc ruptures the disc to provide fluid flow through the passage.

11. The barrier valve of claim 10, wherein the frangible disc is held in the housing such that the disc does not move relative to the housing until after the disc is ruptured.

12. The barrier valve of claim 1, further comprising a viscous lubricant coating on at least a portion of the outer surface of the frangible disc.

13. The barrier valve of claim 12, further comprising a viscous lubricant coating on at least a portion of the inner surface of the cartridge.

14. The barrier valve of claim 1, wherein the elastomeric members are composed of a fluoroelastomer.

15. A barrier valve comprising:

a housing having an outer surface and an inner surface, the inner surface defining a passage through the barrier valve and having a diameter;

an annular cartridge sized to fit concentrically within the passage, the cartridge having an outer surface and an inner surface;

a frangible disc composed of a ceramic material and comprising an annular portion sized to fit concentrically within the annular cartridge and a curved portion that extends outward from one end of the annular portion and blocks the flow of fluid through the frangible disc, the annular portion having a total indicated runout of less than 0.045 inches between its inner and outer surfaces, the outer surface having a surface roughness of less than 64 micro inches (rms);

a first elastomeric member between the outer surface of the cartridge and the inner surface of the housing;

a second elastomeric member between the outer surface of the annular portion of the frangible disc and the inner surface of the cartridge; and a viscous lubricant on the outer surface of the second elastomeric member such that the lubricant penetrates imperfections in the frangible disc in at least the vicinity of the second elastomeric member;

wherein the barrier valve prevents the flow of gas in a direction through the passage for a duration of 15 minutes at a pressure of 10,000 psi and a temperature of 350 degrees F. when the frangible disc, the cartridge, and the elastomeric members are mounted therein;

wherein the lubricant is an oil with a viscosity between 50,000 centistokes and 125,000 centistokes.

16. The barrier valve of claim 15, wherein the barrier valve further prevents the flow of gas in the direction through the passage for a duration of 15 minutes at a pressure of 15,000 psi and a temperature of 400 degrees F.

17. The barrier valve of claim 15, wherein the barrier valve further prevents the flow of gas in the direction through the passage at a temperature of 80 degrees F. and a pressure of 10,000 psi for a duration of 15 minutes.

18. The barrier valve of claim 15, wherein the annular portion of the disc has an outer diameter that is within 0.012 inches of the diameter of the inner surface of the cartridge.

19. The barrier valve of claim 15, wherein the cartridge has a groove in its inner surface for receiving and retaining the second elastomeric member between the inner surface of the cartridge and the outer surface of the annular portion of the frangible disc.

20. The barrier valve of claim 19, further comprising a backup ring in the groove.

21. The barrier valve of claim 20, wherein the backup ring has a grooved surface for interfacing with the second elastomeric member.

22. The barrier valve of claim 20, wherein the backup ring extends outside the groove between −0.001 inches and 0.003 inches before compression.

23. The barrier valve of claim 15, further comprising a viscous lubricant coating on at least a portion of the outer surface of the frangible disc.

24. The barrier valve of claim 23, further comprising a viscous lubricant coating on at least a portion of the inner surface of the cartridge.

25. The barrier valve of claim 15, wherein the elastomeric members are composed of a fluoroelastomer.

* * * * *